United States Patent [19]

Genco et al.

[11] 4,295,426

[45] Oct. 20, 1981

[54] PLASTIC WADS AND WAD ASSEMBLIES FOR SHOT CARTRIDGES

[75] Inventors: Vito Genco, Rome; Vincenzo L. Turco, Colleferro, both of Italy

[73] Assignee: Snia Viscosa Societa Nazionale Industria Applicazioni Viscosa S.p.A., Milan, Italy

[21] Appl. No.: 22,361

[22] Filed: Mar. 20, 1979

[30] Foreign Application Priority Data

Mar. 22, 1978 [IT] Italy ..... 21258/78[U]

[51] Int. Cl.[3] ..... F42B 7/08

[52] U.S. Cl. ..... 102/451; 102/453

[58] Field of Search ..... 102/42 C, 42 P, 95

[56] References Cited

U.S. PATENT DOCUMENTS

| | | | |
|---|---|---|---|
| 3,279,375 | 10/1966 | Herter | 102/42 C |
| 3,590,740 | 7/1971 | Herter | 102/42 C |
| 3,707,915 | 1/1973 | Kerzman | 102/42 C |
| 3,722,420 | 3/1973 | Herter | 102/42 C |
| 3,812,784 | 5/1974 | Herter | 102/42 C |
| 4,151,799 | 5/1979 | Jackson | 102/95 |

FOREIGN PATENT DOCUMENTS

| | | | |
|---|---|---|---|
| 2370258 | 11/1976 | France | 102/95 |
| 1012126 | 3/1977 | Italy . | |

*Primary Examiner*—Harold Tudor

*Attorney, Agent, or Firm*—Wenderoth, Lind & Ponack

[57] ABSTRACT

A deformable plastic wad for shot cartridges for hunting and shooting includes a reticular cushioning structure symmetric with respect to the axis of the wad, including portions located on planes parallel and portions located on planes perpendicular to the axis, the first mentioned portions being adapted to resist axial loads and the second mentioned portions being adapted to bend in two opposite directions, at least some of the first mentioned portions being symmetrically located in the vicinity of opposite edges of the second mentioned portions.

4 Claims, 4 Drawing Figures

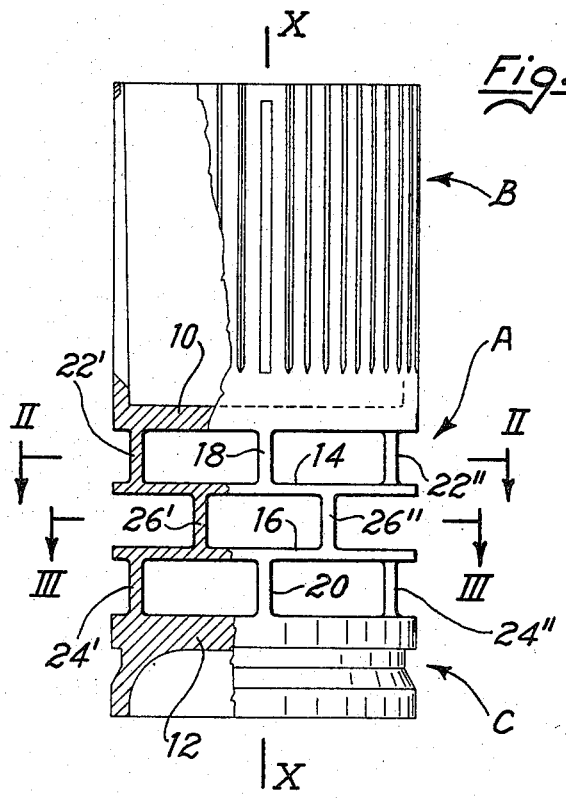
Fig. 1
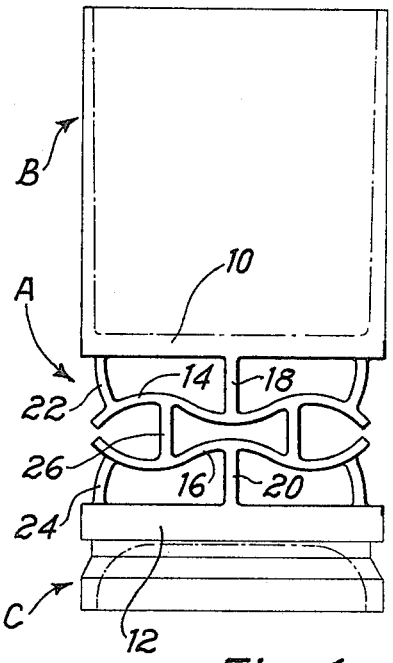
Fig. 4
Fig. 2
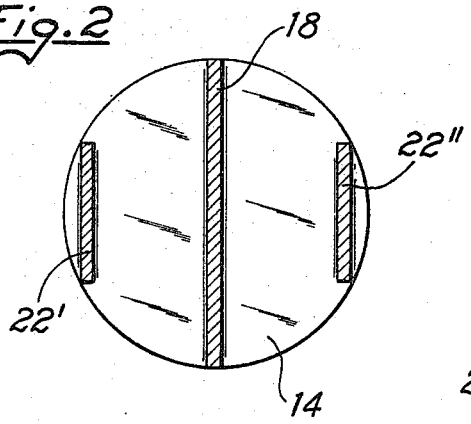
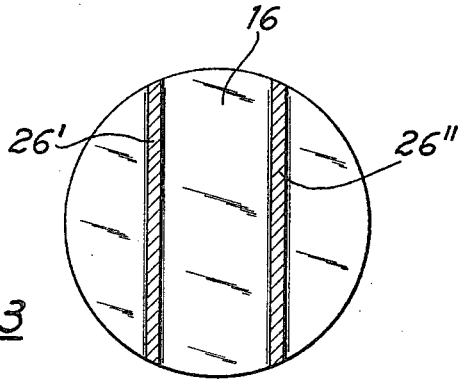
Fig. 3

PLASTIC WADS AND WAD ASSEMBLIES FOR SHOT CARTRIDGES

BACKGROUND OF THE INVENTION (a) The Field of the Invention

This invention refers to wads and wad assemblies for shot cartridges for hunting and shooting. More particularly, this invention refers to wad assemblies formed of one piece, generally including a cup-like shot charge container; a bottom piece intended to be superimposed over the propellant charge and to provide a sliding seal in the gun barrel by acting as a piston to avoid any dispersion of the propellant energy; and additionally an intermediate part which accomplishes the primary task of the wad, which is to amortize the violent thrust applied to the inert mass of the shots as a result of the detonation of the powder.

(b) The prior art

The wads or wad assemblies (actually the word "wad" should properly refer only to the aforesaid intermediate amortizing part, which substitutes for the traditional felt wads) according to the invention are made of thermoplastic, polymeric, substantially deformable material (generally a polyethylene resin) and the actually deformable portion thereof has an essentially reticular structure which includes segments or sections susceptible of bending elastic deformation.

The correct function of the wads, and more specifically of their deformable portion, is very important, not only advantageously to reduce the physiological effect of the recoil, but also to secure the regular propulsion of the shot mass and the distribution thereof in a precisely predetermined and regularly distributed shot pattern. It is particularly important that the shot pattern be regularly reproduced at every shot, which implies that the different wads employed for charging different cartridges behave in the same manner. Their behaviour therefore must be such as not to create different elastic or permanent deformations in different wads or asymmetrical deformations in the wads, or to apply to the shot charge, at the moment of the detonation and during the shot's motion through the gun barrel, propulsive forces not exactly alined with the barrel axis.

SUMMARY OF THE INVENTION

It is an object of this invention to provide a wad or a wad assembly, comprising a reticular cushioning structure symmetric with respect to the axis of the wad, including portions located on planes parallel and portions located on planes perpendicular to the axis, the first mentioned portions being adapted to resist axial load and the second mentioned portions being adapted to bend in two opposite directions, at least some of the first mentioned portions being symmetrically located in the vicinity of opposite outer edges of the second mentioned portions.

BRIEF DESCRIPTION OF THE DRAWINGS

These and other characteristics of the wad according to the invention will be made clear in the course of the following detailed description of a preferred embodiment of the invention, with reference to the attached drawings, wherein:

FIG. 1 is, at an enlarged scale and in detail, a wad according to one embodiment of the invention, partially in lateral view and partially in cross-section, in one of its planes of symmetry;

FIGS. 2 and 3 are cross-sections taken in the traversal planes indicated by II—II and respectively III—III in FIG. 1; and FIG. 4 is a lateral view of the wad of FIG. 3, in a condition of incomplete deformation, resulting from the contrast between the thrust applied by the detonation of the propellant and the inertia of the shot charge.

DETAILED DESCRIPTION OF THE INVENTION

Since the part of the wad to which the invention particularly applies is its deformable and amortizing part, this is illustrated with greater graphic evidence than the other parts, which other parts, individually considered, are characteristic of the invention and may have different configurations and structures.

The wad illustrated comprises an essentially reticular structure A, interposed between cylindrical container B, which can become fractured or more properly spread out for quickly and totally freeing the shot charge after its exit from the gun muzzle, and a cup-like bottom C intended to be superimposed over the powder or propellant charge and to act as a pressure seal.

All these parts are made of one piece of substantially elastic polymeric material, such as a middle or high density polyethylene resin, which material is preferably resistant to low environment temperatures, so that the deformability of the wad will not be affected in winter hunting and shooting.

The height or axial dimension of the reticular structure A may be varied, as the wad should fill the space between the propellant charge and the shot mass, and the volumes of the charge and mass may vary. The structure A as shown corresponds to the case of a wad for a cartridge wherein the space is the smallest, or nearly the smallest possible compatibly with an efficient and regular amortizing effect. In other words, the wad illustrated comprises all the parts which are necessary according to the invention, and other parts may be added if a greater height is required of the structure A to match a greater distance between components B and C.

Reticular structure A is defined between disc-like elements 10 and 12 which form the bottom of the shot container B and the top of the cup-like seal C. These elements 10 and 12, are thick enough to be considered essentially rigid and they are adapted to distribute evenly the propulsive forces over the whole transversal cross-section of the wad.

In the axial interval between the essentially rigid discs 10 and 12, other discs 14 and 16 are interposed, which are thinner and susceptible of bending deformation and to assure a strictly symmetrical deformability, and which are preferably in the number of two. For higher structures A, four of the thinner discs may be provided. Should it be necessary to use intermediate dimensions, if the dimensions of the wad require an odd number of thin discs, one of these could be connected to rigid element 10 or preferably 12 by auxiliary ribs which control and reduce its bending deformability.

Between the different discs and disc-like elements 10, 14, 16, 12 which must be mutually parallel, other elements are arranged, oriented in planes parallel to the axis X—X of the wad or containing such axis, and symmetrical with respect to such axis or to the plane which contains it. Between each pair of elements 10 and 14 and 12 and 16, a diametral rib, 18 and 20 respectively, is placed. Each such diametral rib is symmetrically flanked by a pair of ribs 22'-22" and 24'-24" respectively, which lie in planes parallel to the axis of the wad (that is, to the plane which contains the ribs 18 and 20). As better seen in FIG. 2, the ribs 22'-22" and 24'-24" are placed closely near the circular edges of the discs to which they are adjacent, and therefore correspond to chords of arcs of the circle defined by such edges and have a length which is not greater (and preferable smaller) than the radius of the circle, that is to say, than half the length of diametral ribs 18 and 20. This is a critical condition for obtaining the results of the invention.

Between the deformable discs 14 and 16, ribs 26' and 26" are interposed, which are always parallel and symmetrically placed with respect to the diametral plane which contains ribs 18 and 20, and they are spaced at a distance equal or approximately equal to the distance between the ribs interposed between the elements 10 and 14 and between elements 12 and 16.

The discs 14 and 16 are constructed in such a way that they are capable of undergoing significant bending deformations, while the ribs 18-26" are constructed in such a way that they withstand a significant axial load without becoming deformed, or at most while bending to the extent needed to match the slants acquired by the marginal tracts of the discs 14 and 16 under stress.

These structural elements and relationships, which have proved critical to obtain an optimal and reproduceable performance of the wad, have the effects which can be seen from a comparative examination of FIGS. 1 and 4. The ribs 18 and 20, which lie in a plane which contains the axis of the wad, withstand the stresses without becoming deformed. The discs 14 and 16 behave as beams supported at the center (by ribs 18 and 20) at the ends (by ribs 22 and 24) and loaded (by ribs 26) at intermediate points (practically, in the middle) between the respective support points. Given the parallelism of the ribs 26' and 26" and the symmetry of the deformable system with respect to the transversal plane located half-way between elements 14 and 16, ribs 26' and 26" also withstand the axial load without undergoing deformations.

The remaining ribs 22', 22", 24' and 24" become deformed, but to a limited extend and exclusively by bending, either for matching the slants of the marginal portions of discs 14 and 16, or for compensating for the fact that the external support points, draw closer due to the wavy, S-like configuration acquired by the discs in bending.

The described geometrical conditions cause the deformations to be exclusively bending deformations and to be symmetrically distributed with respect to three mutually orthogonal planes, viz. the two planes (one of which contains the ribs 18 and 20) which cross each other at right angles at the axis of the wad, and the third plane, perpendicular to such axis, half-way between discs 14 and 16.

If the aforesaid geometrical conditions are observed for the properly amortizing part, structural changes may be introduced without impairing the efficiency of the device. If the spacing between the rigid disc-like elements 10 and 12 requires the provision of an odd number of bendingly deformable discs, variably oriented auxiliary ribs could be provided, to counterbalance the dissymmetry of the transmission of the thrusts and of the stresses with respect to a plane perpendicular to the axis of the wad.

Since most of the deformation is absorbed by the discs 14 and 16, these will be preferably made with thicknesses (e.g. of 0.8 mm, for calibers from 16 to 12) smaller than those (e.g. of 1.0 mm) of the ribs which work under axial compression, that is, which behave like rafters with respect to the discs which behave as bending beams.

We claim:

1. A deformable plastic wad assembly for shot cartridges for hunting and shooting, said wad assembly comprising:

a first substantially rigid disc-like member extending perpendicular to a longitudinal axis of the wad assembly and forming a bottom of a shot container;

a second substantially rigid disc-like member extending perpendicular to said axis and forming a top of a seal adapted to be adjacent a powder charge; and a reticular cushioning structure symmetric with respect to said axis and positioned between said first and second disc-like members, said cushioning structure comprising:

at least first and second discs axially spaced from each other and extending perpendicular to said axis, said discs being capable of bending in two opposite directions;

first and second ribs extending parallel to each other and to said axis on opposite lateral sides of said axis, said first and second ribs extending between and being connected to said first and second discs;

a first set of ribs extending between and being connected to said first disc-like member and said first disc, said first set of ribs comprising a first diametral rib extending in a plane containing said axis and first and second lateral ribs located symmetrically on opposite sides of said first diametral rib and extending parallel to each other and to said first diametral rib, said first and second lateral ribs being disposed along and forming chords of the periphery of said first disc, which chords have lengths, in directions parallel to the plane of said first disc, which are less than the radius of said first dics;

a second set of ribs extending between and being connected to said second disc-like member and said second disc, said second set of ribs comprising a second diametral rib extending in a plane containing said axis and third and fourth lateral ribs located symmetrically on opposite sides of said second diametral rib and extending parallel to each other and to said second diametral rib, said third and fourth lateral ribs being disposed along and forming chords of the periphery of said second disc, which chords have lengths, in directions parallel to the plane of said second disc, which are less than the radius of said second disc;

all of said ribs being of a construction to resist axial loading; and said first and second ribs being spaced from each other by a distance approximately equal to the distances spacing said first diametral rib from said first and second lateral ribs and to the distances spacing said second diametral rib from said third and fourth lateral ribs.

2. A wad assembly as claimed in claim 1, wherein the thickness of said ribs is at least five fourths of the thickness of said discs.

3. A wad assembly as claimed in claim 1, wherein said first and second disc-like members and said cushioning structure are integrally formed of a single member of a polymeric material which maintains its elasticity in the presence of atmospheric agents at winter temperatures.

4. A wad assembly as claimed in claim 3, wherein said material comprises polyethylene.

* * * * *